US009496628B2

(12) United States Patent
Snyder

(10) Patent No.: US 9,496,628 B2
(45) Date of Patent: Nov. 15, 2016

(54) BUNDLED WIRE SEPARATOR HAVING SEPARATING FINS

(71) Applicant: Robert V. Snyder, Mechanicsburg, OH (US)

(72) Inventor: Robert V. Snyder, Mechanicsburg, OH (US)

( * ) Notice: Subject to any disclaimer, the term of this patent is extended or adjusted under 35 U.S.C. 154(b) by 0 days.

(21) Appl. No.: 14/808,747

(22) Filed: Jul. 24, 2015

(65) Prior Publication Data

US 2016/0028168 A1 Jan. 28, 2016

Related U.S. Application Data

(60) Provisional application No. 62/028,642, filed on Jul. 24, 2014, provisional application No. 62/116,731, filed on Feb. 16, 2015.

(51) Int. Cl.

| | |
|---|---|
| ***H01R 9/22*** | (2006.01) |
| ***H01R 4/42*** | (2006.01) |
| ***H01R 9/24*** | (2006.01) |
| *H01R 103/00* | (2006.01) |
| *H01R 4/34* | (2006.01) |
| *H01R 13/58* | (2006.01) |
| *H01R 24/78* | (2011.01) |
| *H01R 25/00* | (2006.01) |

(52) U.S. Cl.

CPC ..... *H01R 4/42* (2013.01); *H01R 9/2416* (2013.01); *H01R 4/34* (2013.01); *H01R 13/5804* (2013.01); *H01R 24/78* (2013.01); *H01R 25/006* (2013.01); *H01R 2103/00* (2013.01)

(58) Field of Classification Search

CPC ..... H01R 9/22; H01R 9/24; H01R 13/58; H01R 13/582; H01R 13/5804; H01R 13/5812; G02B 6/4452; H04Q 1/06; H04Q 2201/02

USPC ..... 439/719, 470

See application file for complete search history.

(56) References Cited

U.S. PATENT DOCUMENTS

| | | | | |
|---|---|---|---|---|
| 5,067,910 A * | 11/1991 | Knox | H01R 4/2433 | 439/402 |
| 2006/0086530 A1* | 4/2006 | Knabel | H01R 25/16 | 174/135 |
| 2013/0277086 A1* | 10/2013 | Rohmer | H05K 5/02 | 174/51 |
| 2016/0204589 A1* | 7/2016 | Rohmer | H02G 3/086 | 174/51 |

* cited by examiner

*Primary Examiner* — Chandrika Prasad

(74) *Attorney, Agent, or Firm* — James R. Eley; Eley Law Firm Co. LPA

(57) ABSTRACT

A separating and contact assembly into which a sheathed or bundled wire cable may be inserted having separating fins to separate the component wires of the bundle guided through separate channels to terminal contact areas conductively coupled to relay contact areas.

20 Claims, 17 Drawing Sheets

BUNDLED WIRE SEPARATOR HAVING SEPARATING FINS

CROSS-REFERENCE TO RELATED APPLICATIONS

This application claims priority to and the benefit of U.S. Provisional Application No. 62/028,642 filed Jul. 24, 2014, and U.S. Provisional Application No. 62/116,731 filed Feb. 16, 2015, which are hereby incorporated by reference in their entirety.

TECHNICAL FIELD.

Exemplary embodiments of the present invention relate generally to devices for installation at a terminating end of a bundled or sheathed cable whereby the component wires of the cable are separated and secured at terminals.

BACKGROUND OF THE INVENTION

Electricians are generally paid by the hour and are often paid one of the highest wages of the craftsmen constructing a building; therefore, anything that can improve an electrician's efficiency or otherwise reduce the amount of time that electricians are needed on a construction site can have a substantial effect on the bottom line for a construction project.

Conventionally, devices exist which require a skilled craftsmen to make multiple visits to a project location over an extended period of time. For example, an electrician installs an electrical box that will house a three prong electrical outlet. On a first visit, the electrician would fasten the box to a structural support. Then the electrician would run wires from an electrical source to the box. The wires would be bound up and left inside the box, because the electrician cannot finish installation until, e.g., sheet rock, wood, tiling, fiber board or other paneling is installed. Then on a second trip, which may be days, weeks or months later, the electrician would connect each individual wire to each terminal of the electrical appliance being installed inside each box or housing. The installation would be different for each different type of electrical appliance or housing, in that the installation procedure for an electrical outlet is not that same as for a switch, for instance. The multiple visits coupled with the different installation procedures—with associated and required intricate knowledge—increase the project's costs due to the electrician's services. Furthermore, varied wiring procedures increase the risk of error. However, a device as described in the following detailed description provides advantages over conventional devices.

It is therefore an unmet need in the prior art for a device that will increase both the speed and efficacy of electrical wiring activities. No known references, taken alone or in combination, are seen as teaching or suggesting the presently claimed apparatus for separating component wires of a bundled wire into contact assemblies for ready and secure methods of electrical wiring.

BRIEF SUMMARY OF THE INVENTION.

Exemplary embodiments of the present disclosure pertain to bundled cable or wire termination in an assembly with separating fins for separating the component wires of the bundle into separate channels and into terminal contact areas. The terminal contact areas are conductively coupled to relay conduct areas, greatly simplifying, for example, the pre-wiring process of a structure.

An object of the present invention is to provide a fast and robust means of separating and terminating the ends of components wires at individual terminals in an assembly. Another object of the present invention is to limit the required trips that an electrician is required to make to a new build by simplifying the final steps of the installation process.

It is an object of this invention to provide a bundled wire component separator and contact assembly of the type generally described herein, being adapted for the purposes set forth herein, and overcoming disadvantages found in the prior art. These and other advantages are provided by the invention described and shown in more detail below.

BRIEF DESCRIPTION OF THE SEVERAL VIEWS OF THE DRAWINGS.

Novel features and advantages of the present invention, in addition to those mentioned above, will become apparent to those skilled in the art from a reading of the following detailed description in conjunction with the accompanying drawings wherein identical reference characters refer to identical parts and in which.

DETAILED DESCRIPTION OF THE INVENTION

Exemplary embodiments of the invention are directed to assemblies configured to separate component wires of a bundled wire from the bundle at a terminating end, and to secure the terminating ends of the component wires thus separated at contact terminals conductively connected to corresponding relay terminals, an electrical device, or both. The device may further be provided with a means for electrically shielding the component wires from contact with one another, and in a structure that may be readily installed into prewired electrical device housing.

Figure 1:
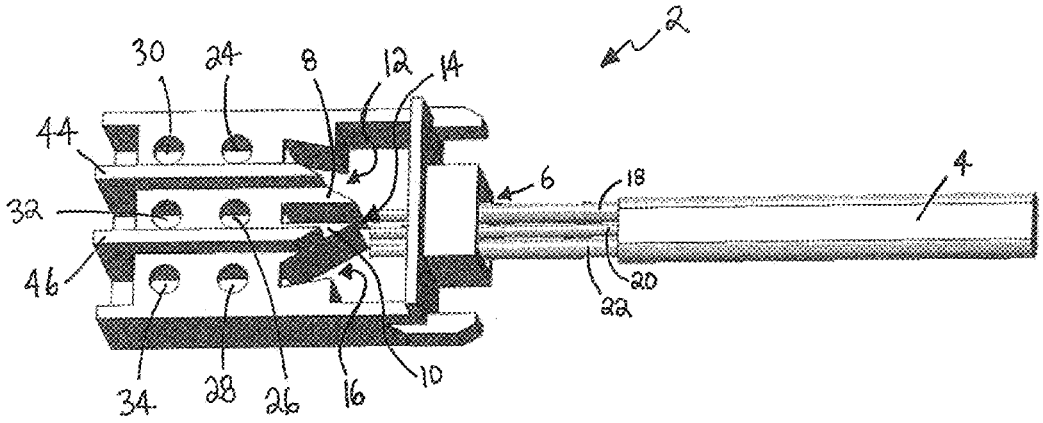
FIG. 1 is a perspective view of a first exemplary embodiment of a contact assembly.

One exemplary embodiment of such a device or assembly 2 is shown in connection with FIGS. 1-5. FIG. 1 depicts a perspective view of the assembly 2 with a terminating end of a bundled wire 4 entering through a bundled wire inlet 6. The assembly 2 is provided for use with bundled wires 4 such as an electrical transmission wire commonly used to distribute electricity through a home or other such structure, for instance. The particular bundled wire 4 depicted by way of example in the following disclosure is standard Romex three-strand two-conductor sheathed electrical cable. However, it will be readily apparent to those skilled in the art that the teachings of this disclosure may be applied to prepare the terminal ends of many types of bundled/sheathed wiring having varied numbers of component wires/strands for use in a wide variety of applications.

The contact assembly 2 may be configured with one or more separating fins, such as the left separating fin 8 and the right separating fin 10 depicted in FIG. 1. The number of separating fins in a particular embodiment will depend upon the type of bundled wiring (e.g., 4) in a particular application, and preferably will total N-1, wherein N is the number of component wires contained within the bundle. Configuring an embodiment for use with a Romex three-strand bundled wire, for instance, will result in N=3 for a total of two separating fins (e.g., 8 and 10). The separating fins extend forwardly from a back interior surface and are preferably shaped with a tearing or cutting tip facing the interior opening of the bundled wire inlet 6. Wedge shaped fins are considered useful and provide an optional feature in assisting in separation of the sheathing around the component wires to assist in the processes of separating those components from one another, although blunt edges may also be provided and the component wires separated prior to insertion.

Additionally, the separating fins 8 and 10 are spaced apart to create component wire channels 12, 14 and 16. Each component wire channel 12, 14 and 16 corresponds to and receives an individual component wire after separation. For example, channels 12, 14 and 16 in FIG. 1 receive component wires 18, 20 and 22, respectively. The bundled wire 4 is fed into the bundled wire inlet 6 until the component wires are separated into each corresponding channel and into terminal contact areas 24, 26 and 28.

Terminal contact areas 24, 26 and 28 represent generally conductive contact receptacles to secure the terminating ends of the component wires 18, 20 and 22. A preferred method utilizes screws (not shown) to retain the terminating ends of the component wires in the contact area. Other methods of providing an electrical connection comparable to the screw terminal, now known or later developed, may be used for retaining the terminating end of a wire, including but not limited to spring biased platens or post terminals.

Figure 2:
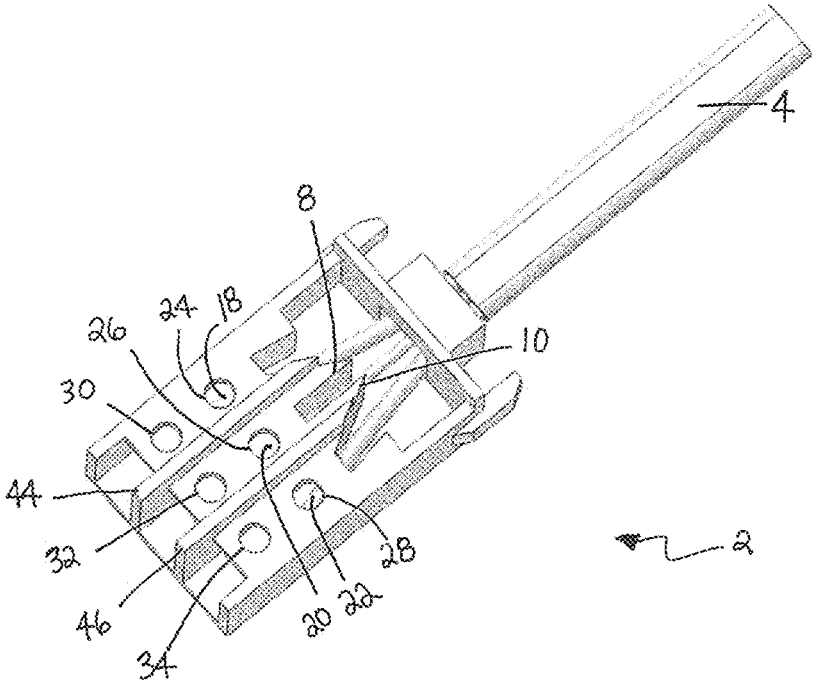
FIG. 2 is an top perspective view thereof.

Turning to FIG. 2, the contact assembly 2 is shown in a perspective view with the top bundled wire inlet 6 end facing generally rightward. Relay contact areas 30, 32 and 34 provide electrical connections for relay wires that will electrically connect the bundled wire component wires 18, 20 and 22 to another electrical device (e.g., a 120V grounded power outlet, a switch, etc.) by way of the relay wires (not shown). In this manner, the contact assembly may effectively house a terminal block for retaining and connecting the terminal and relay component wires in contact areas 24, 26, 28, 30, 32 and 34.

Figure 3:
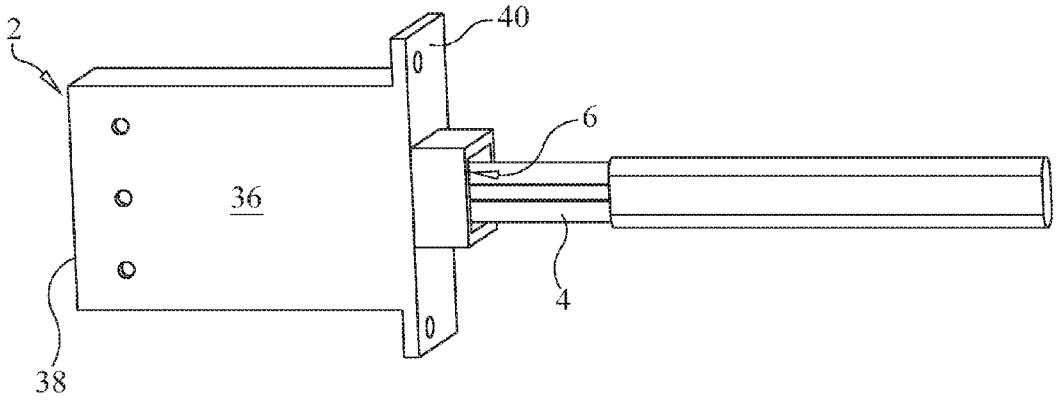
FIG. 3 is an rear view thereof.
Figure 4:
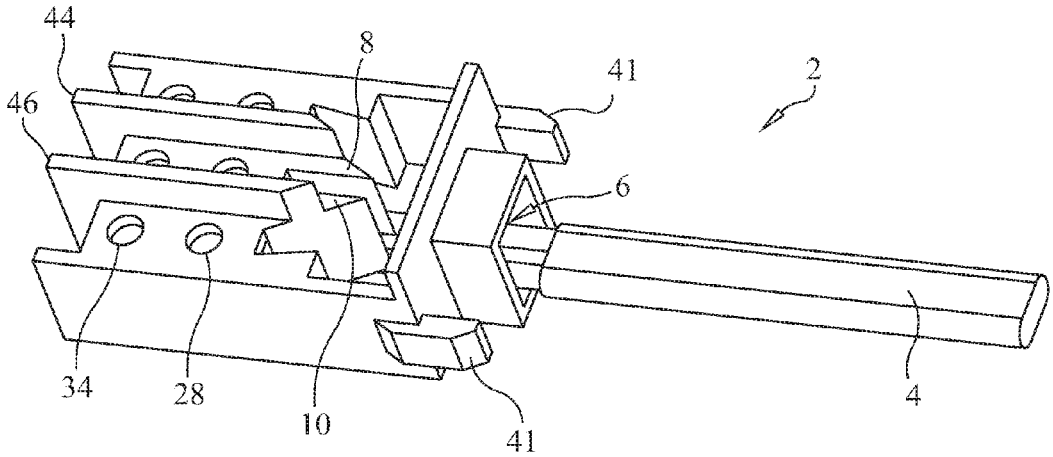
FIG. 4 is a side view thereof.

FIG. 3 depicts the an exemplary embodiment similar to that shown in FIGS. 1-2 from a back view showing the back surface 36 of the contact assembly 2. The bottom edge 38 of the assembly is oriented toward the left of the view, with the bundled wire 4 entering through the inlet 6 at the right of the view. Retaining element 40 is configured in this embodiment to rest upon the top or outside surface of a housing when installed. FIG. 4 depicts the exemplary embodiment of the assembly 2 as shown in FIGS. 1-2 in a side perspective view, and showing an alternate retaining element 41 configuration provided by retaining tabs to snap into a complementary shaped receptacle in a housing.

Figure 5:
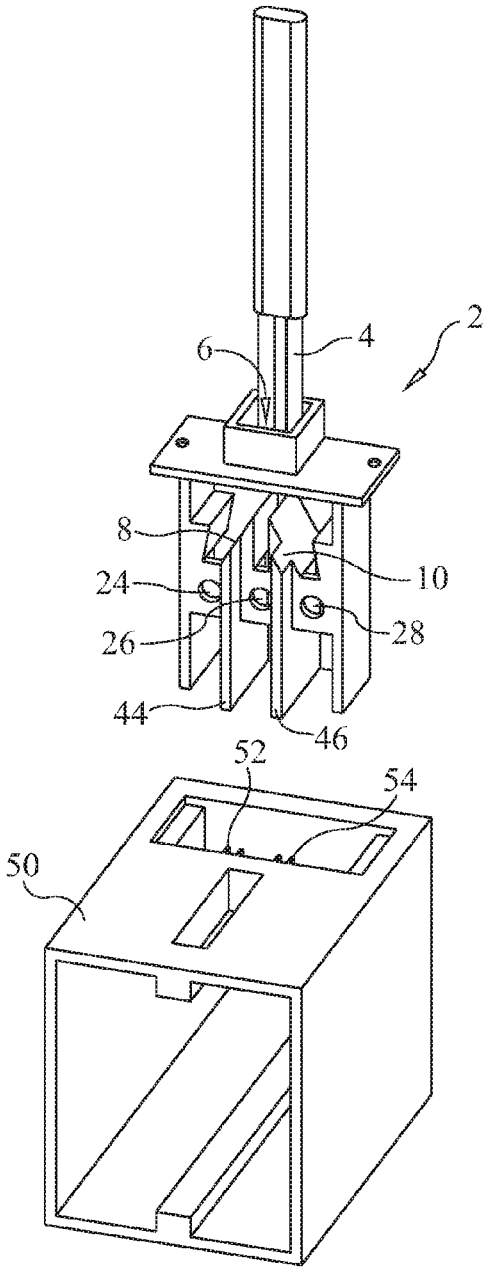
FIG. 5 is a perspective view of the exemplary embodiment depicted in FIG. 3 in use with an exemplary electrical device housing.

FIG. 5 illustrates a use for an exemplary embodiment of the assembly 2 in which residential grade transmission wire 4 is inserted into the bundled wire inlet 6, whereby the component wires are separated by the separating fins 8, 10 and secured in the contact areas 24, 26 and 28. Relay wires (not shown) may be connected to the assembly 2 for coupling to an electrical device intended for use and mounted within a housing 50. Housings such as shown at 50 may preferably be configured for use with prewired electrical devices in a manner similar to that disclosed in United States Patent Publication No. 2013/0045624 A1 also filed by the inventor. However, other uses for quick and secure connection methods of bundled wire components in various other installations will be readily apparent to those skilled in the art.

Also shown in FIG. 5 is the optional extension 44 and 46 of each separating fin 8 and 10, respectively, to provide support and retention of the assembly 2 in optional retaining guides 52 and 54 in the particular installation, such as the housing 50, being utilized in a given application. The extensions 44 and 46 may also be provided as an anti-arcing safety feature by providing a non-conductive barrier between the individual contact areas, or between terminal-relay contact area pairs.

Figure 6:
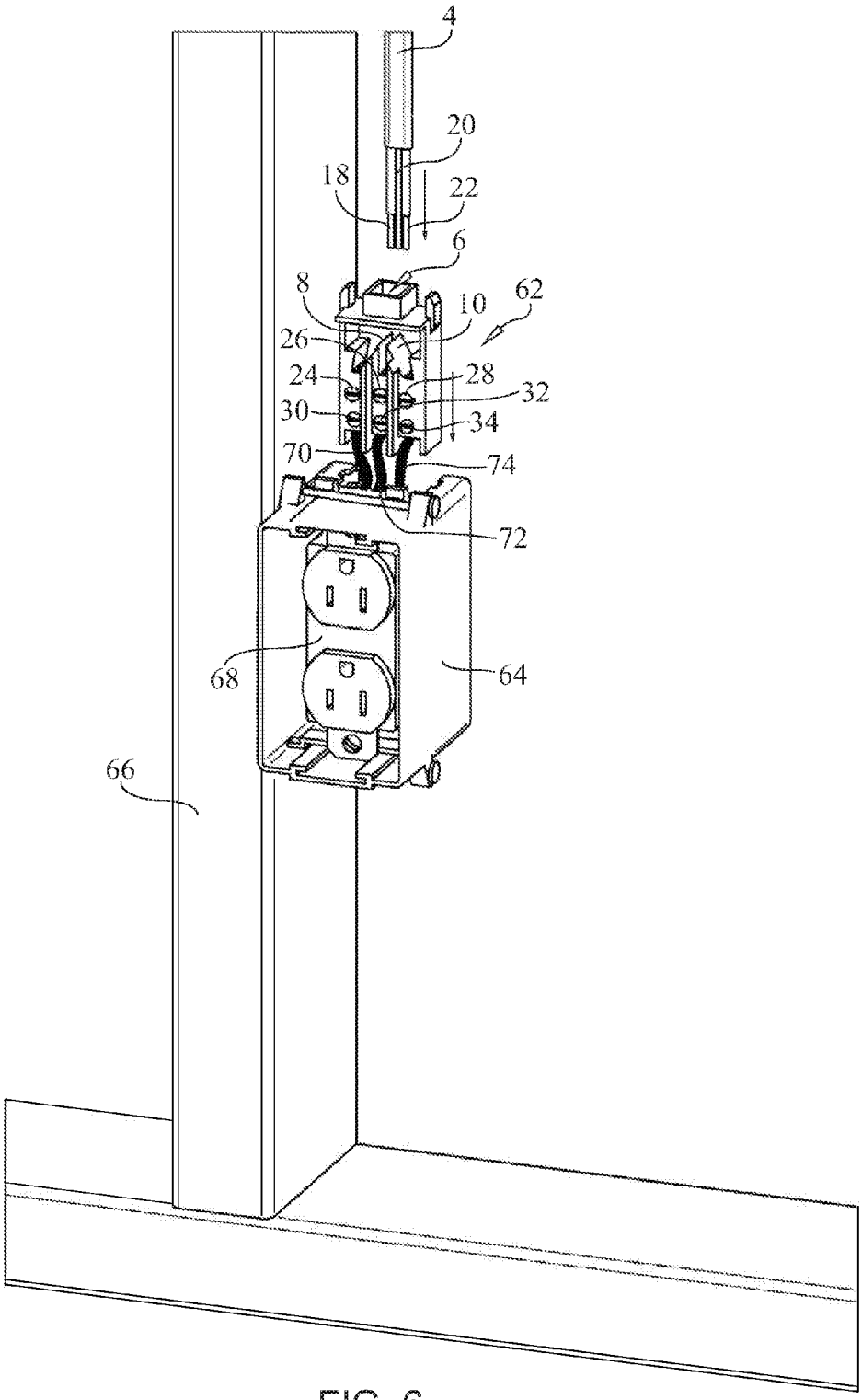
FIG. 6 is a perspective view of an exemplary embodiment of the contact assembly in use with a further exemplary electrical device housing.

Turning now to a second exemplary embodiment of the contact assembly 62 shown in connection with FIG. 6, an illustrative housing 64 is shown into which the contact assembly 62 may be installed. The housing 64 is fastened to a stud 66 to which sheetrock or other such wall paneling is to be hung. The housing 64 may be configured to house common residential electrical devices such as standard receptacles 68, switches, junctions, and other such devices. Relay component wires 70, 72 and 74 electrically couple the receptacle 68 electrical connections (not shown) to the contact assembly 62 at the relay component wire contact terminals 30, 32 and 34, respectively.

Figure 7:
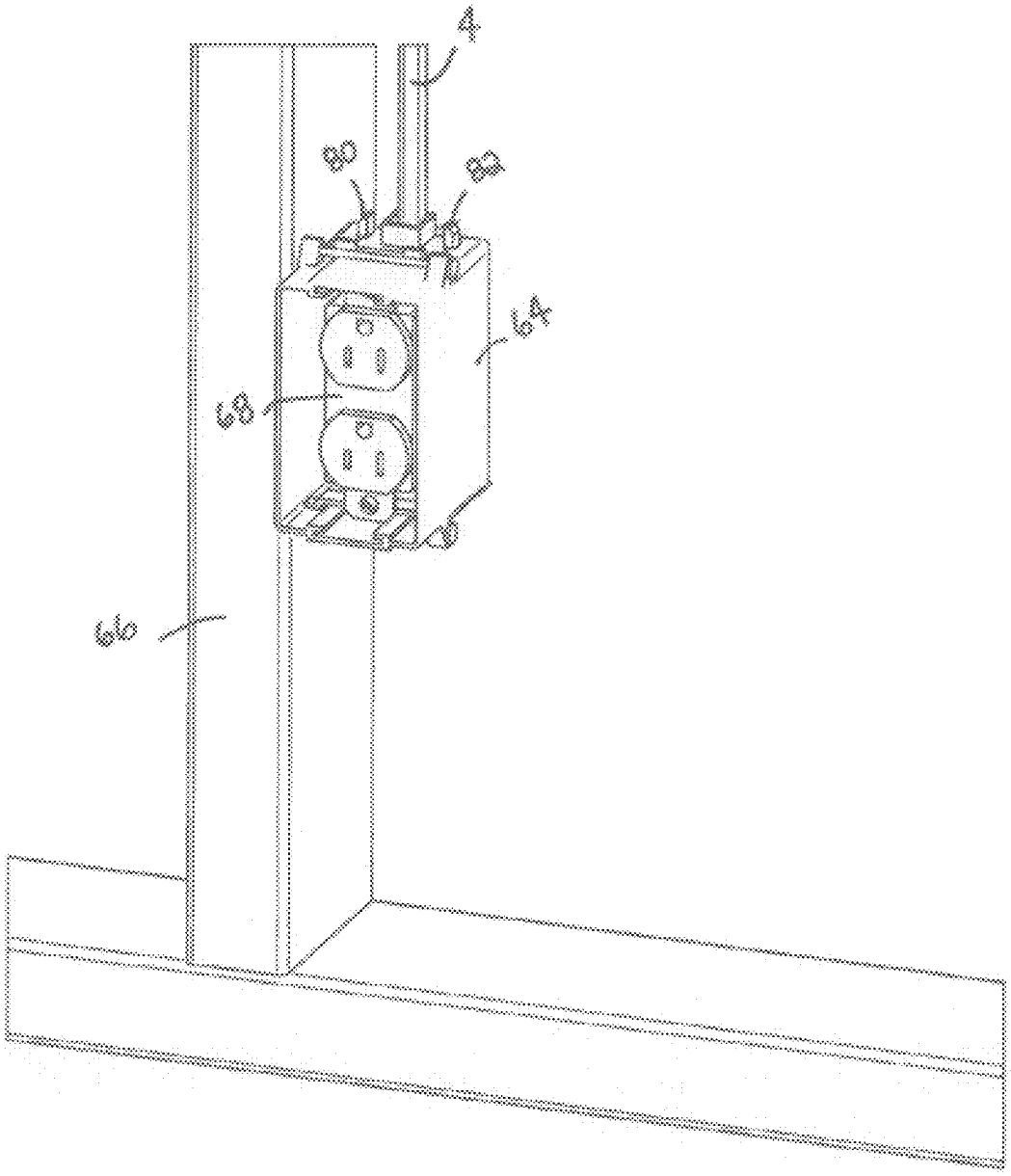
FIG. 7 is a further perspective view thereof.

In this embodiment, the bundled wire is a Romex sheathed electrical cable 4. The bundled wire 4 is shown above the bundled wire inlet 6 with three component wires 18, 20 and 22. FIG. 7 is a view of the assembly 62 shown in FIG. 6 installed into the electrical device housing 64. In this embodiment, retaining clips 80 and 82 are provided to retain the assembly in the position shown until it requires servicing or an upgrade of the transmission cable 4.

Figure 8:
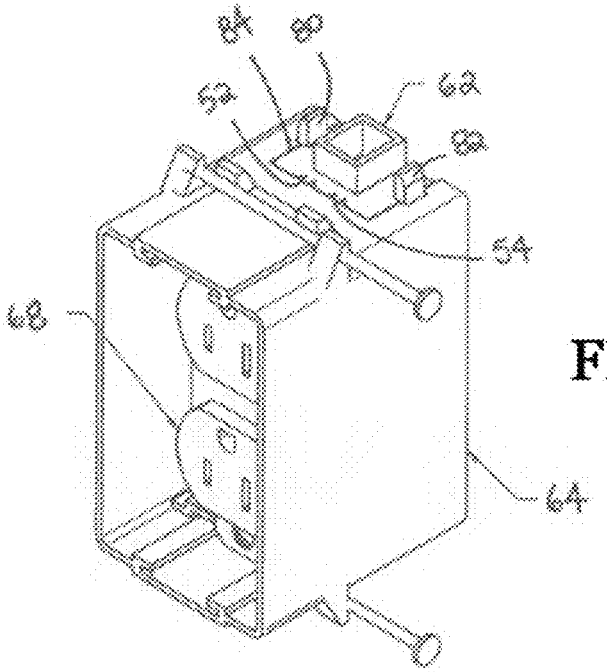
FIG. 8 is a further perspective view thereof.
Figure 9:
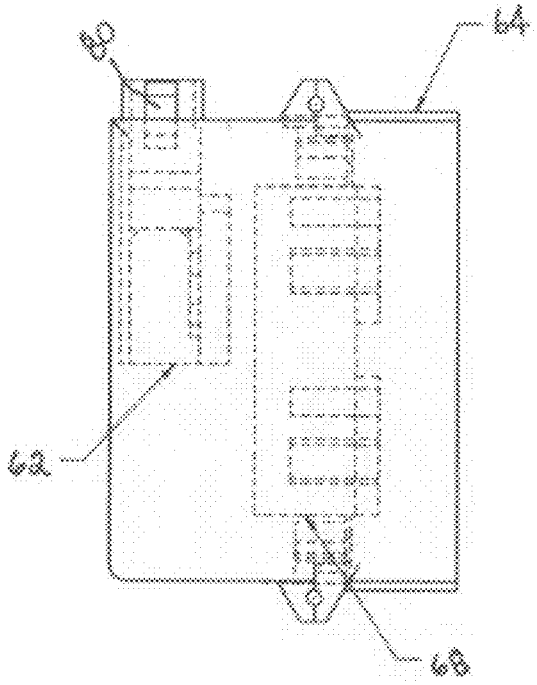
FIG. 9 is a side view thereof.

This embodiment of the contact assembly 62 is also shown in an isolated perspective view in FIG. 8 and a side view in FIG. 9, secured within a contact assembly aperture 84 in the housing 64. The retaining clips 80 and 82 are shown in a locked position, requiring inwardly-directed force to dislodge the contact assembly 62 from the aperture 84 in the housing 64. Note also the use of retaining guides 52 and 54 through which the extended separating fins (e.g., 8) or other such extensions of the contact assembly 62 (i.e., are structurally independent of the separating fins) are received when seating the contact assembly 62 within the aperture 84 of the housing 64.

Figure 10:
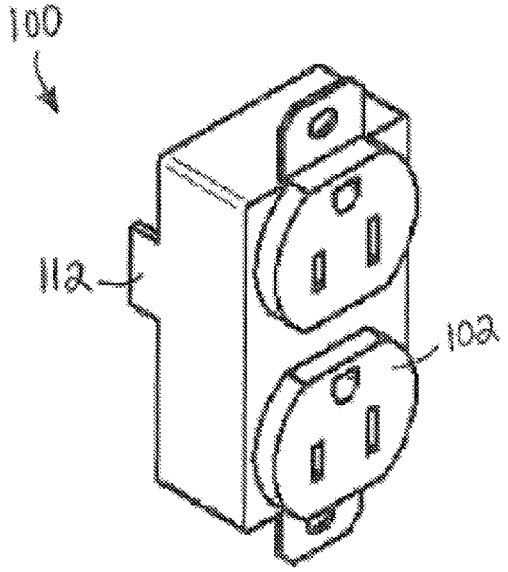
FIG. 10 is a front perspective view of a further exemplary embodiment of the contact assembly.
Figure 11:
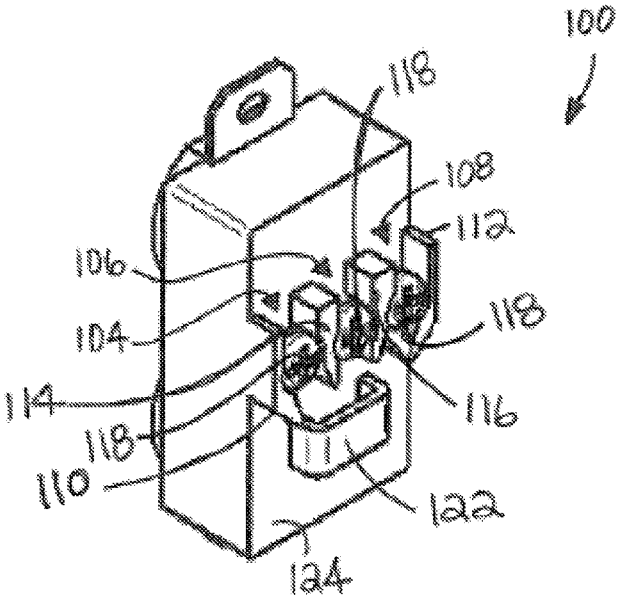
FIG. 11 is a rear perspective view thereof.

Turning to FIGS. 10-11, a further exemplary embodiment of a contact assembly 100 according to the principles of the present invention is shown in connection with an exemplary electrical device such as an outlet receptacle 102. This exemplary contact assembly 100 also provides component wire channels 104, 106 and 108 corresponding to a bundle wire having three component wires (not shown), for instance. Those skilled in the art will appreciate that more or less may be provided without departing from the scope of the invention disclosed herein. Each of the component wire channels 104, 106 and 108 are formed with protrusions or walls, for example side walls 110 and 112 and separating fins 114 and 116, where the number of separating fins is at least equal to or greater than N-1, wherein N is the number of component wires contained within the bundle. The separating fins have an edge at one end and facing the entry direction of a bundled wire, such that the component wires will be separated from one another, and will facilitate the direction of the wires into corresponding component wire channels to be fixed each in a contact area. In the embodiment shown in connection with FIGS. 10-11, for example, each of the component wire channels 104, 106 and 108 respectively direct component wires directed therein to contact areas. A variety of securing mechanisms may be used to couple a portion of each of the component wires to the contact areas, for instance set screws 118, or clamps or other such known equivalents. The contact areas are then electrically and operatively connected to the electrical device in order to transmit electrical power thereto.

Figure 12:
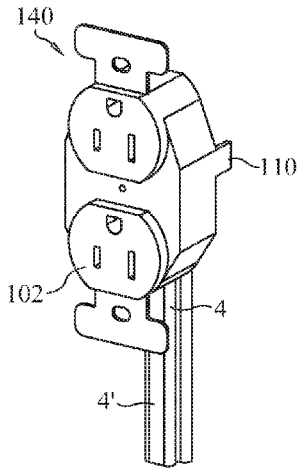
FIG. 12 is a front perspective view of a further exemplary embodiment of the contact assembly.
Figure 13:
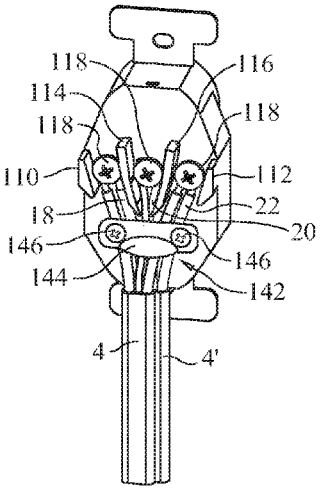
FIG. 13 is a rear view thereof.
Figure 14:
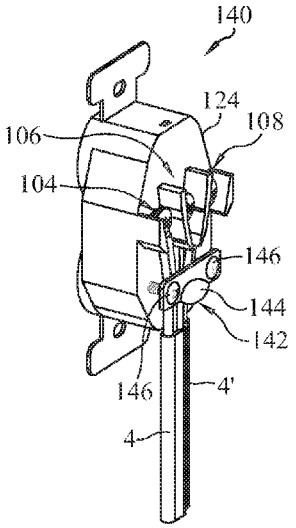
FIG. 14 is a rear perspective view thereof.

The exemplary embodiment of a contact assembly 100 as shown in connection with FIGS. 10-11 may also be provided with a strain relief component 122, at least a portion of which is positioned to encapsulate a bundled wire once the component wires are affixed to the contact areas. The strain relief component 122 may, for example, be embodied as an arch protruding from a portion of the back surface 124 of the electrical device 102, and generally provides protection from forces transmitted to the contact areas by jostling and general movement of the bundled wire with respect to the contact assembly 100 and electrical device 102. Another, similar exemplary embodiment of the present invention 140 is shown in connection with FIGS. 12-14, wherein like components are numbered identically to those in FIGS. 10-11. In this exemplary embodiments 140, the strain relief component 142 is provided as a lateral bracing section 144 separable from the back surface 124 of the electrical device 102, which may be affixed to thereto via set screws 146 or other comparable mechanical fasteners once the component wires 18, 20 and 22 have been affixed to the contact areas. Note also the connection of two bundle wires 4 and 4', allowing for continuation of an electrical circuit as will be readily apparent to those skilled in the art. In this manner, the strain relief components may be sized to accommodate multiple bundle wires or may be adjustable to secure a range of bundled wires that may be desired in a specific application. The use of tightening screws 146, as shown in FIGS. 12-14, is useful in such embodiments.

Figure 15:
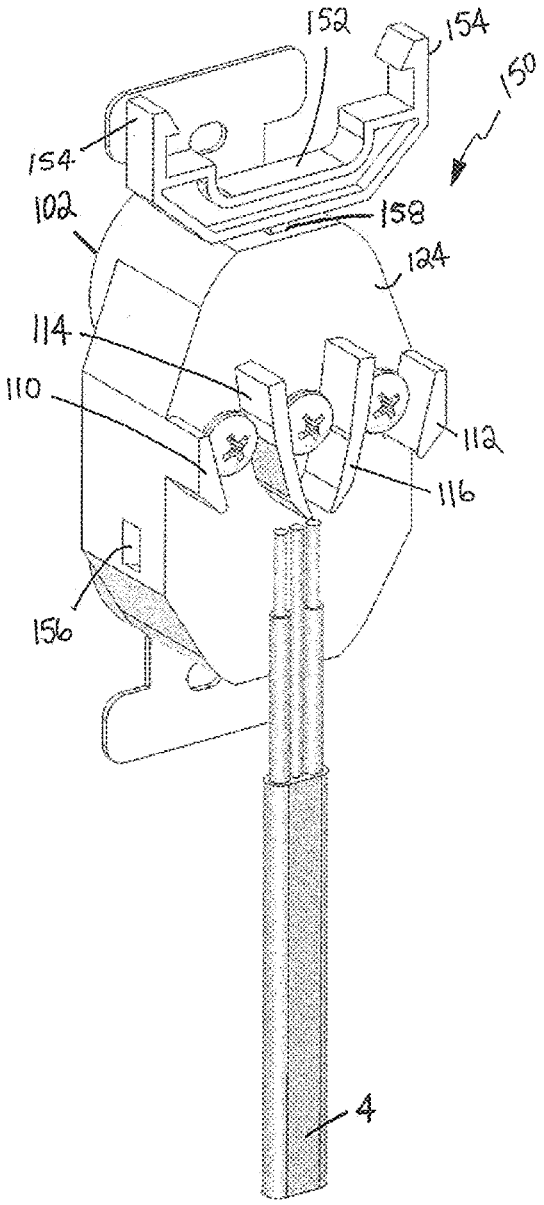
FIG. 15 is a rear perspective view of a further exemplary embodiment of the contact assembly.
Figure 16:
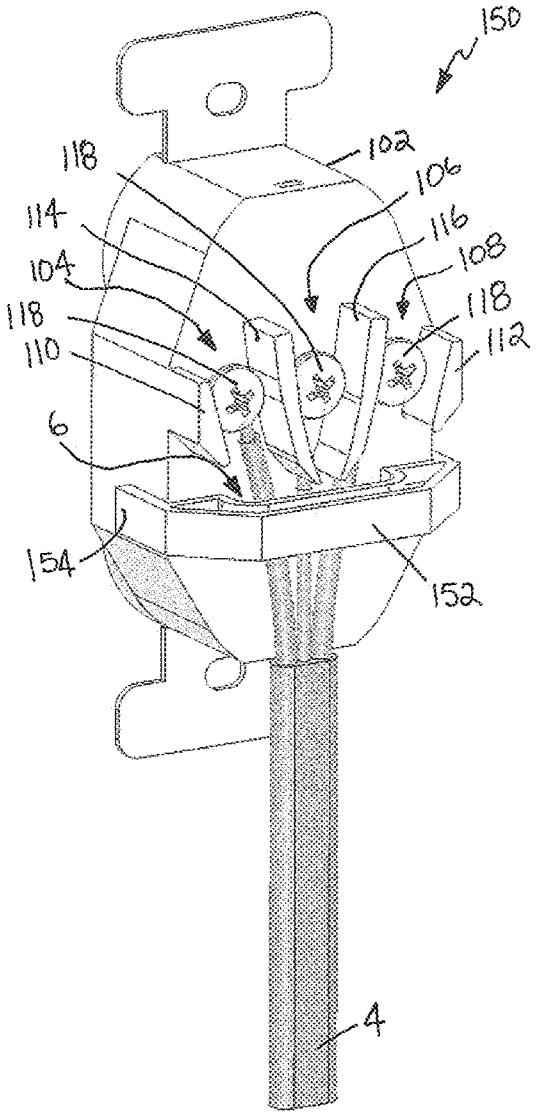
FIG. 16 is a further rear perspective view thereof.

A similar exemplary embodiment 150 of the invented contact assembly is shown in connection with FIGS. 15-16. Here, the contact assembly 150 is provided with a snap-on type strain relief component 152, which is placed laterally across the back surface 124 of the electrical device 102 to secure one or more bundled wires and provide strain relief to the component wires when affixed to the contact areas by set screws 118 or other such mechanical fasteners as described above. As provided in the previously described embodiments, the strain relief component 152 defines a bundled wire inlet 6, and in this embodiment snap fits into place with gripping arms 154 extending along the sides of the electrical device 102 wherein grooves 156 are used to hold the strain relief component 152 securely in place. This optional configuration is preferred in part because the strain relief component 152 is removable, providing ready access when installing the component wires, and also because it may be formed as part of a single molded body attached by a thin breakable portion of material 158, thereby providing reduced manufacturing costs over embodiments such as the strain relief component 142 shown in connection with FIGS. 12-14.

Figure 17:
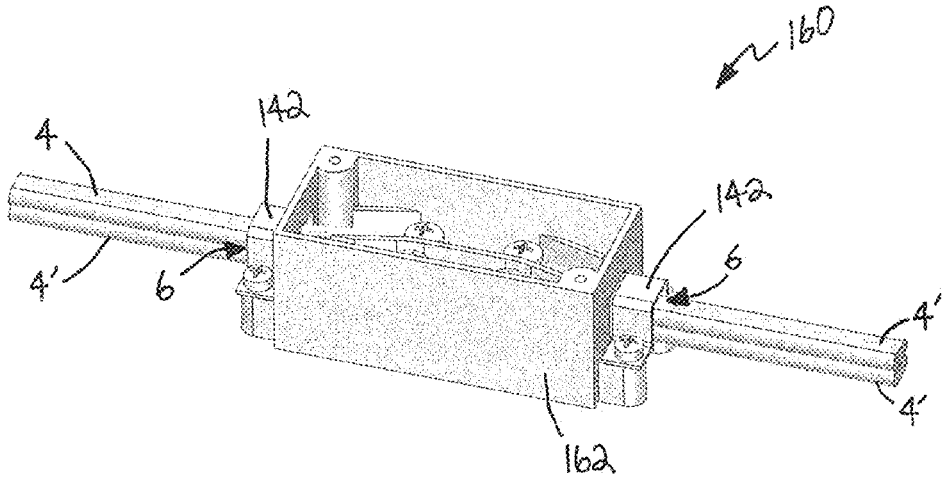
FIG. 17 is a side perspective view of a further exemplary embodiment of the contact assembly.
Figure 18:
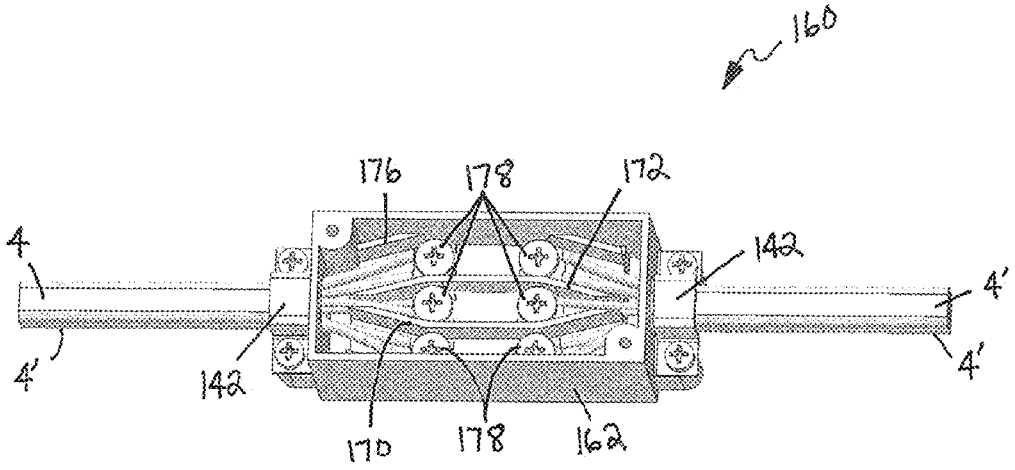
FIG. 18 is a further perspective view thereof.
Figure 19:
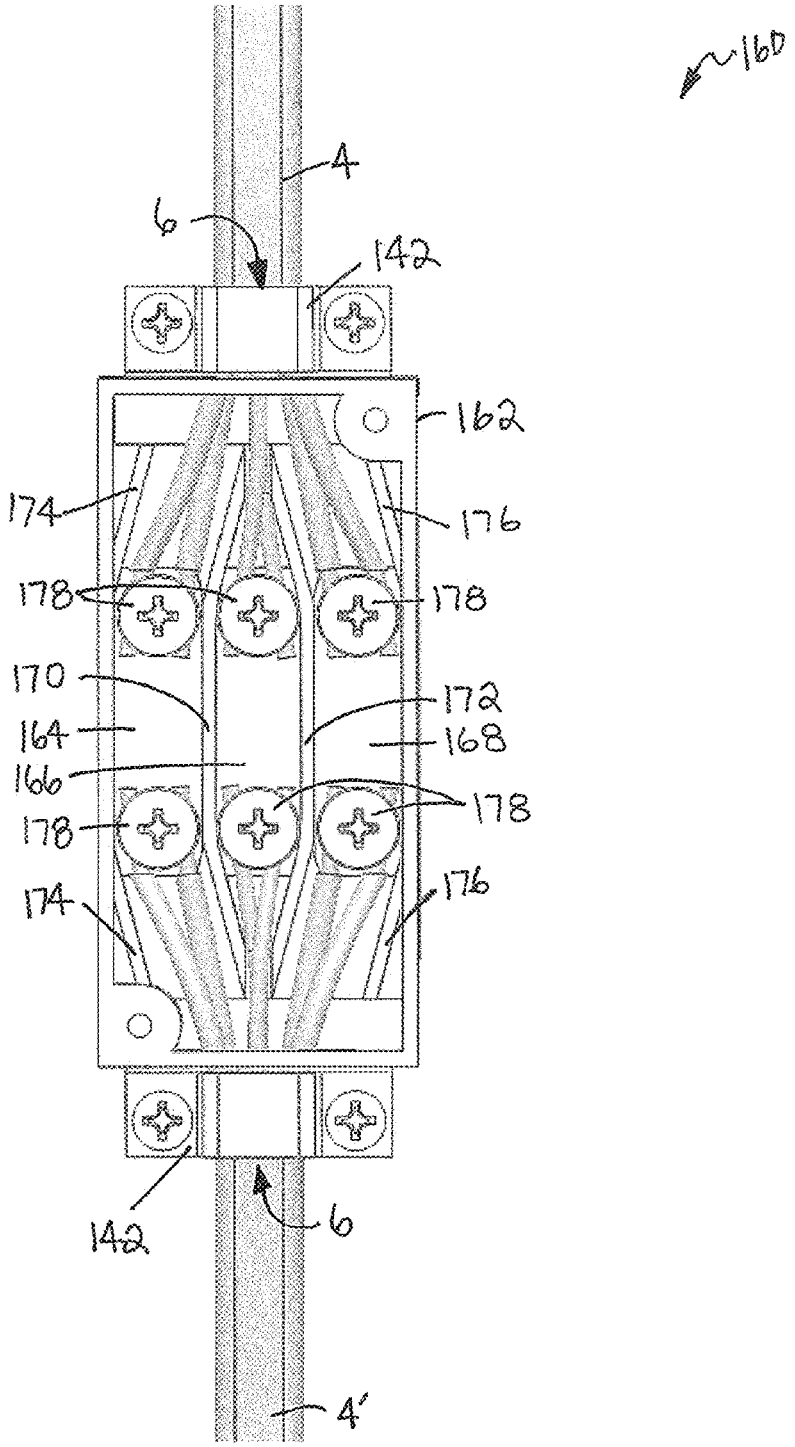
FIG. 19 is a front view thereof.

Yet another exemplary embodiment of the invented contact assembly 160 is shown in connection with FIGS. 17-19. Here, the contact assembly 160 is applied in connection with a typical electrical device housing 162, such as those used to mount an electrical outlet receptacle, switch or the like. Two bundled wire inlets 6 are shown, although more or less may be employed without departing from the scope of the present invention. In this example, one bundled wire 4 carries electrical current into the device housing 162, which is then split into three bundled wires 4' carrying current away from the device housing 162.

Here, three component wire channels 164, 166 and 168 are again formed with two separating fins 170 and 172, but on an interior surface of the device housing 162. In this embodiment, the electrical components of the contact assembly 160 are thus shielded by the device housing 162 exterior. Also in this embodiment, note that both ends of each separating fin 170 and 172 are formed with an edge facing and proximate to a bundled wire inlet 6 such that the component wires will be separated from one another, and will facilitate the direction of the wires into corresponding component wire channels to be fixed each in a contact area. If desired, optional side wall protrusions 174 and 176 may additionally be utilized to define the component wire channels, although in applications such as the use with the device housing 162, the side walls of the housing 162 may optionally be used to serve that purpose as well.

Each of the component wire channels 164, 166 and 168 should generally include at least one terminal contact area with a securing means 178 wherein an electrical connection may be made with a component wire of the bundled wires 4 and 4'. In preferred embodiments, there may be at least one contact area for each bundled wire inlet, such as in the embodiment shown in connection with FIGS. 17-19, wherein two contact areas and set screws 178 (or other comparable fastening means as noted above) are shown in each component wire channel 164, 166 and 168. These attachments points are conductively coupled using an one of a variety of known mechanisms, for instance by using strips of conductive metal to connect the two posts 178 in each component wire channel 164, 166 and 168.

Note also that, in the embodiment shown in FIGS. 17-19, a strain relief component 142 of the type described in connection with FIGS. 12-14 is used at each bundled wire inlet 6 to secure the bundled wires 4 and 4', although those skilled in the art should appreciate that other alternatives as described herein may be used if desired, without departing from the scope of the invention. Therefore, combinations and subcombinations of the features described herein are considered disclosed and covered by the claims set forth below.

Figure 20:
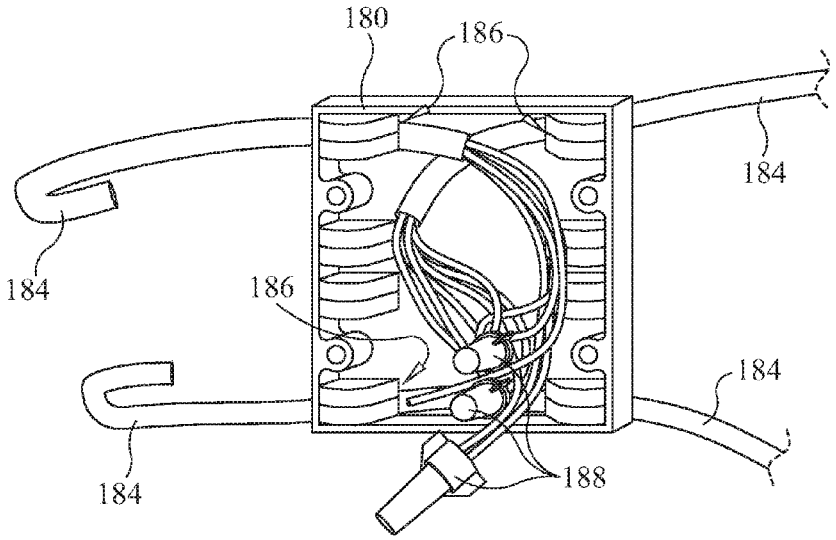
FIG. 20 (PRIOR ART)
FIG. 20 is a perspective view of a known junction box configuration.
Figure 21:
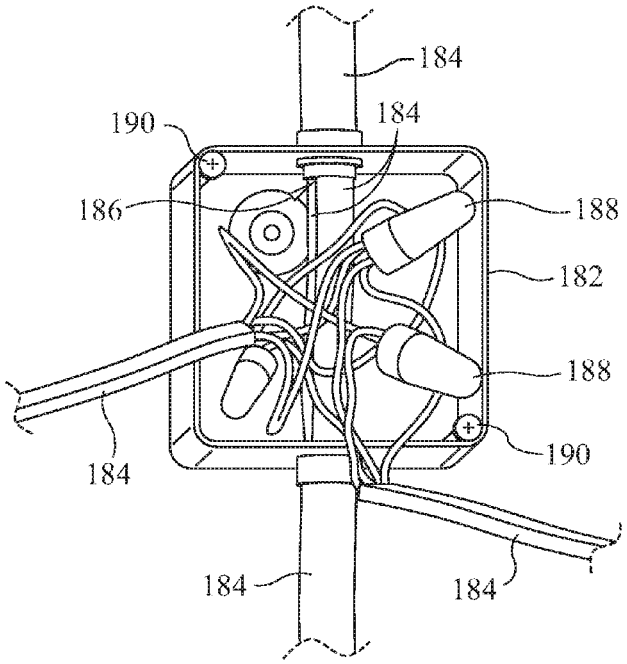
FIG. 21 (PRIOR ART)
FIG. 21 is a perspective view of another known junction box configuration.

The features of the present invention disclosed herein have also been found useful in connection with other similar problems present in the prior art. Two examples of prior art junction boxes 180 and 182 are shown in connection with FIGS. 20-21, respectively. These illustrate a typical manner of securing and protecting an electrical junction in a wire structure, wherein multiple bundled wires 184 are electrically coupled within hollow housings 180 and 182 that have several points of entry 186 and an open face permitting access therein. Bundled wires are typically stripped and separated manually into their component wires, which are in turn twisted together and capped with wire nuts 188. The wires are then forced into the hollow housings 180 and 182 after work is complete, and coverings are affixed over the open face, commonly done with at least two screws in corresponding threaded apertures in the junction box, such as those shown at 190 in FIG. 21. As shown in the illustrations, however, the result is often a mess of tangled wires that are difficult to work with and further still to alter or add to subsequent to the initial installation. Furthermore, points of entry, such as those in FIG. 21, may become full and the open face left uncovered to provide more room for bundle wire entry, creating dangerous conditions.

Figure 22:
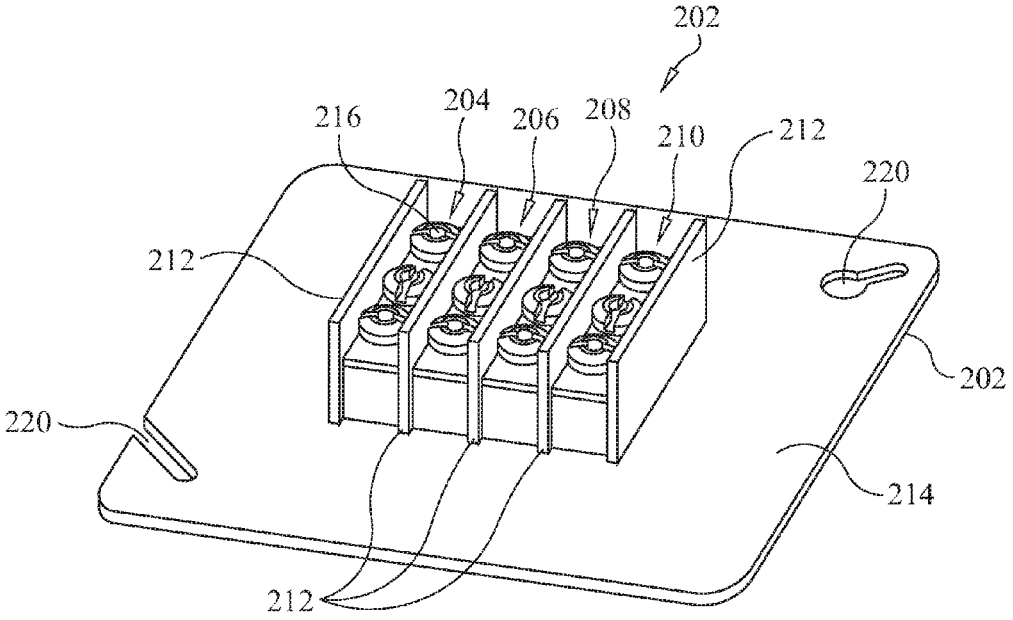
FIG. 22 is a rear perspective view of a further exemplary embodiment of the contact assembly.
Figure 23:
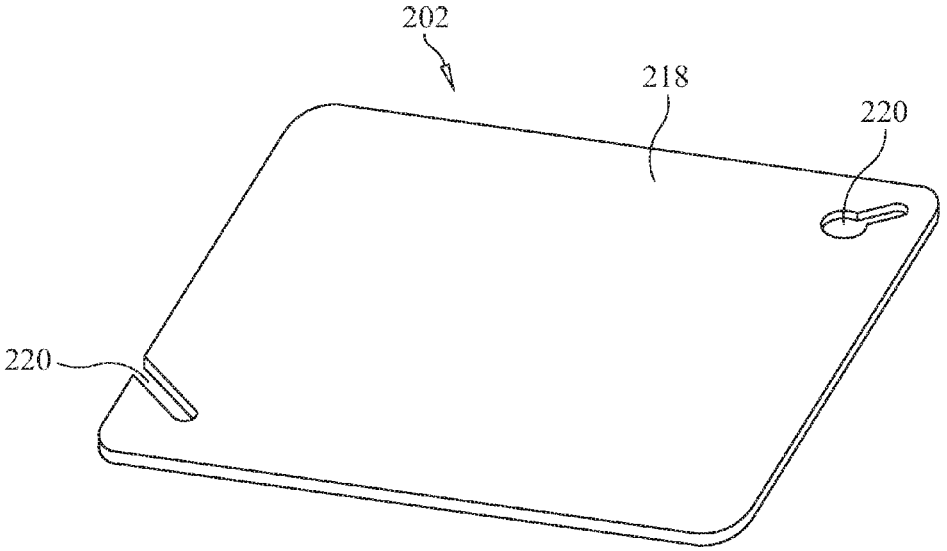
FIG. 23 is a front perspective view thereof.
Figure 24:
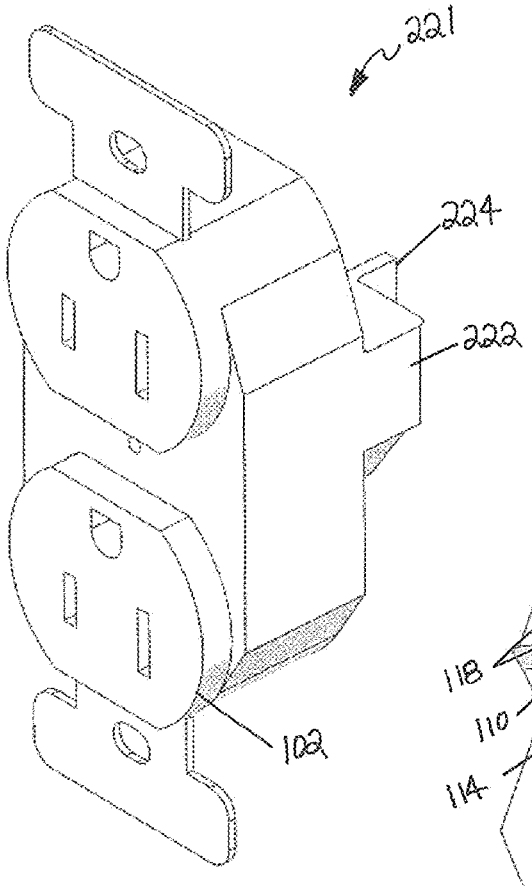
FIG. 24 is a perspective view of a further exemplary embodiment of the contact assembly.
Figure 25:
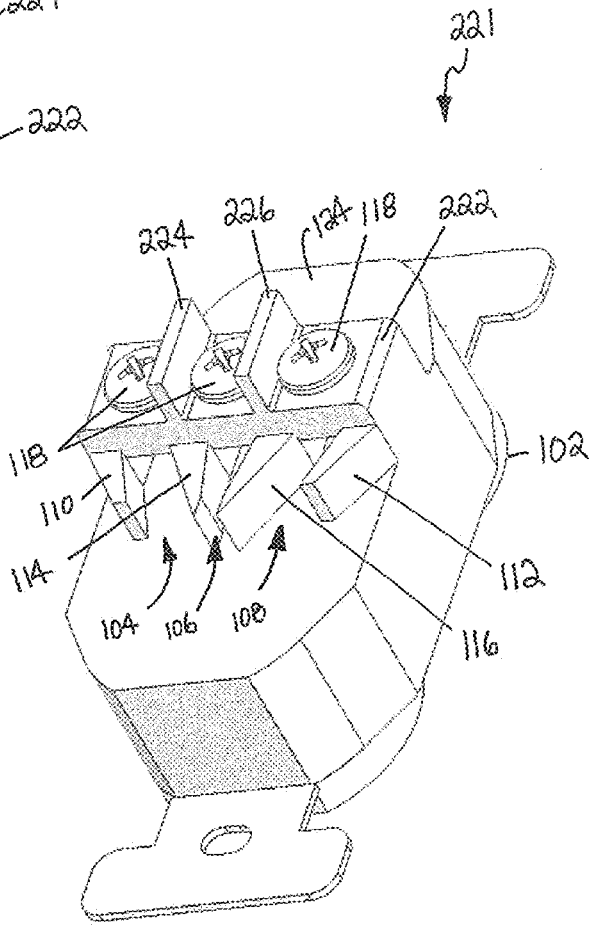
FIG. 25 is an upward looking rear perspective view thereof.
Figure 26:
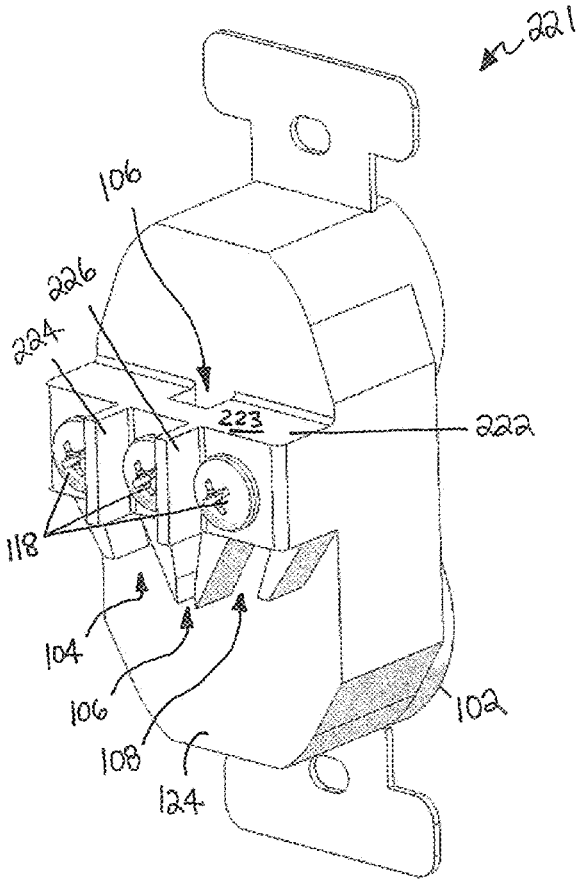
FIG. 26 is a side-rear perspective view thereof.
Figure 27:
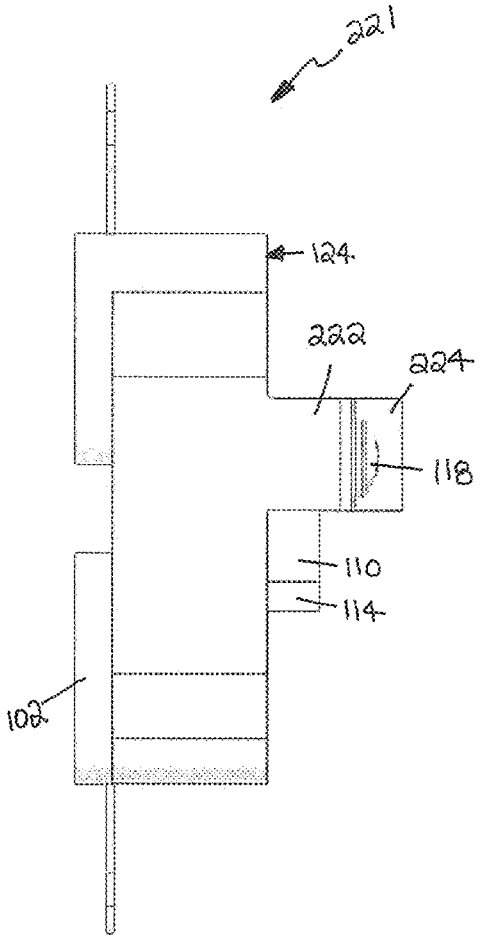
FIG. 27 is a side view thereof.
Figure 28:
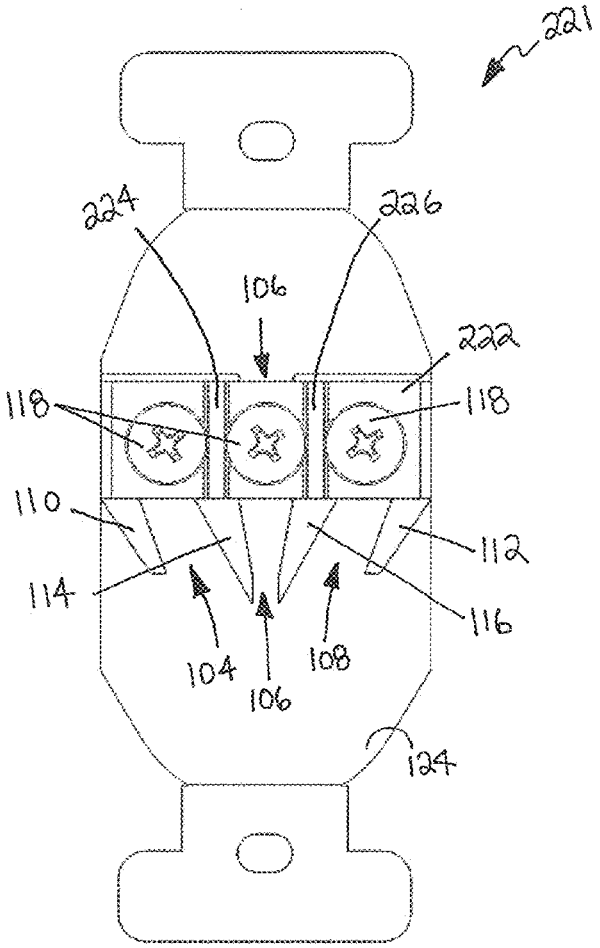
FIG. 28 is a rear view thereof.

In FIGS. 22-23, an embodiment of the invented contact assembly is shown in connection with a junction box cap 202. The cap or plate 202 is rectangular, although a multitude of shapes can be used in order to provide for use of the assembly with the various standard junction box shapes available on the market—e.g., square, rectangular, octagon, circular, etc. The cap and assembly may be manufactured in a variety of non-limiting ways, for example by molding plastic, steel stamping or the like.

A plurality of component wire channels 204, 206, 208 and 210 are defined by protrusions or walls 212 projecting outwardly from the back face 214 of the cap 202. One or more terminal contact areas are provided in each of the component wire channels, such as a contact strip 215, including at least one conductive contact receptacle 216 to secure the terminating ends of the component wires (not shown) therein. The preferred method shown in this embodiment, for instance, utilizes screws 216 to retain the terminating ends of the component wires in the respective contact area for each component wire channel 204, 206, 208 and 210. Specifically, two conductive contact receptacles 216 are provided for the contact area of each component wire channel 204, 206, 208 and 210, for a total of eight screws 216. Note that center screws 217 are depicted as a means for fastening the conductive strips 215 within the component wire channels 204, 206, 208 and 210, although other means of fastening may readily be substituted, such as clip and slot or press fit configurations, adhesives and other such comparable means for securing a contact area to the cap 202. Those skilled in the art will appreciate that more or less may be provided, and that other methods of providing an electrical connection comparable to the screw terminal, now known or later developed, may be used for retaining the terminating end of a wire, including but not limited to spring biased platens or post terminals, without departing from the scope of the invention disclosed and claimed herein.

FIG. 23 is a perspective view of the front side of the cap 202 showing a generally flat front face 218. Apertures 220 are provided at common locations such that the contact assembly/cap 202 can be affixed to existing junction boxes already in use in the field, such as the junction box 152 configuration shown in connection with FIG. 21, for example. The wire nuts 188 may simply be removed, the ends of the wires attached to the contact areas of the contact assembly in the desirable electrical configuration, and the cap 202 affixed to the junction box 182 by aligning the screws with the apertures 220 and 190.

Figure 31:
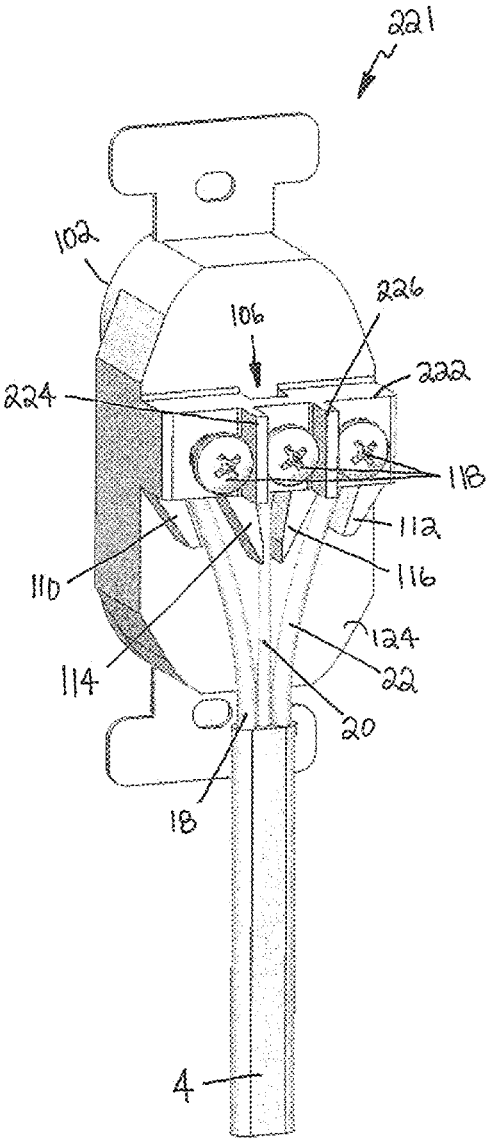
FIG. 31 is a rear perspective view of the exemplary embodiment depicted in FIG. 29.
Figure 32:
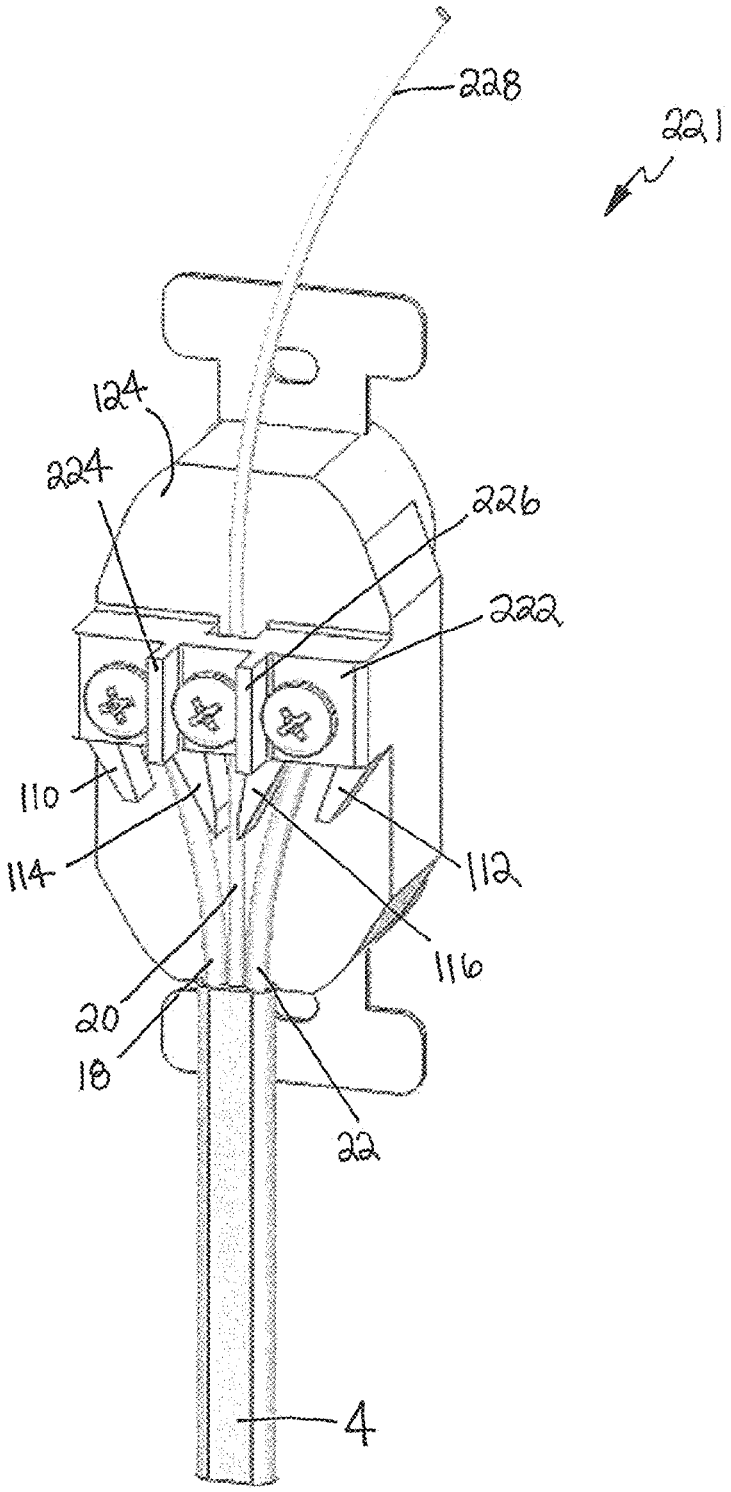
FIG. 32 is a rear perspective view of the exemplary embodiment depicted in FIG. 29 in use with another exemplary electrical ground wire.

FIGS. 24-32 illustrate a further exemplary embodiment 221 of the invented contact assembly. Here the contact assembly 221 further includes a bridge 222, which may be integrally formed with the electrical device or housing (e.g., outlet 102 as shown or housing 162 as shown in connection with FIGS. 17-19, for instance), or may be otherwise attached thereto. The bridge 222 may span the back surface 124 of the device 102 and may receive the component wires 18, 20 and 22 of the bundled wire 4, and assist in affixing the component wires 18, 20 and 22 therein. The bundled wire 4 may be inserted from the bottom of the contact assembly 221 and the component wires 18, 20 and 22 may be separated by the side walls 110 and 112 and separating fins 114 and 116 into the component wire channels 104, 106, and 108, respectively. The component wires 18, 20 and 22 may be inserted until the ends of at least component wires 18 and 22 contact a rear surface 223 of the bridge 222. In exemplary embodiments of the present invention, the rear surface 223 of the bridge 222 at the middle component wire channel 106 may not have material such that the component wire channel 106 extends therethrough, or may be otherwise provided with an aperture to that effect. This may permit the insertion of a component ground wire 228, as illustrated in FIG. 32, in place of the traditional ground lug found on the side of common electrical outlet devices in use today. The middle set screw 118 (or other such comparable fasteners as now known or later developed), in exemplary embodiments of the present invention, may secure and contact the component ground wire 228 and the middle component wire(s) 20.

The bridge 222 may comprise apertures across the top surface of the bridge 222 for the placement of set screws 118. In exemplary embodiments of the present invention, the bridge 222 comprises three such apertures and three such set screws 118, though any number of apertures and corresponding set screws 118 is contemplated. The apertures may be threaded to receive the set screws 118. In other exemplary embodiments, the apertures may not be threaded and the set screws 118 may pass through and be threaded into threaded holes located on the back surface 124. However, the use of a bridge 222 as a set screw anchor point is preferred as the stress and strain of the wires connected thereto is not directly transferred to the device 102 itself. Set screws 118 may assist in affixing the component wires 18, 20 and 22 and may provide for electrical conduction from the component wires 18, 20 and 22 to internal components of the device 102 (not shown). The bridge 222 may further comprise a number of insulating fins 224 and 226. The insulating fins 224 and 226 may be placed between apertures for the set screws 118 and provide electrical resistance and insulation to prevent electrical arcing between the set screws 118. In exemplary embodiments of the present invention, the contact assembly 221 has two insulating fins 224 and 226 to extend between the three apertures and three set screws on the bridge 222, though any number of insulating fins 224 and 226 corresponding to any number of apertures and set screws 118 is contemplated. In some embodiments, the insulating fins may be integral with the separating fins and extend through the bridge, or may alternatively be formed of separate pieces.

Figure 29:
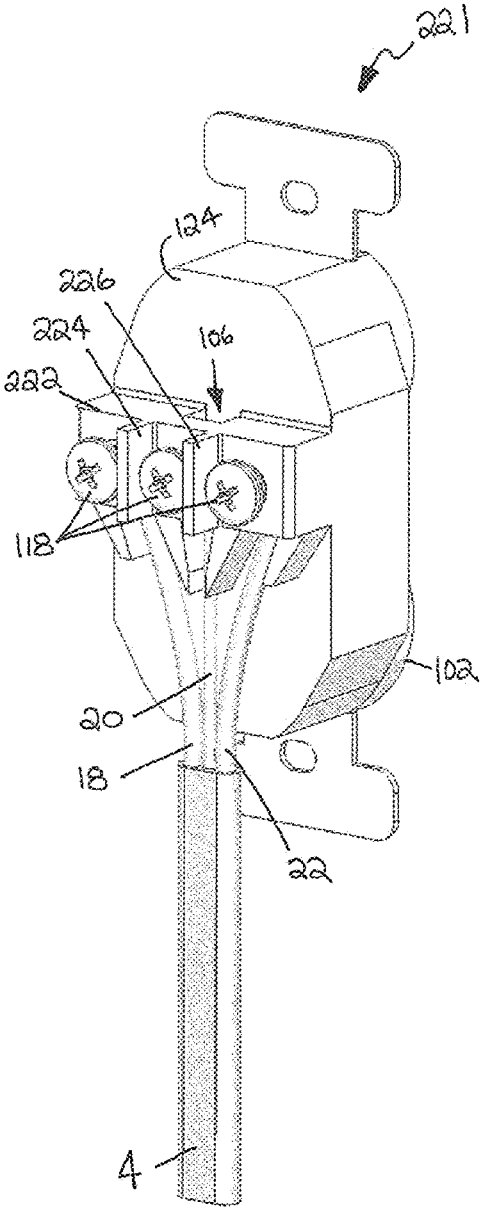
FIG. 29 is a downward looking rear perspective view thereof in use with an exemplary bundled electrical wire.
Figure 30:
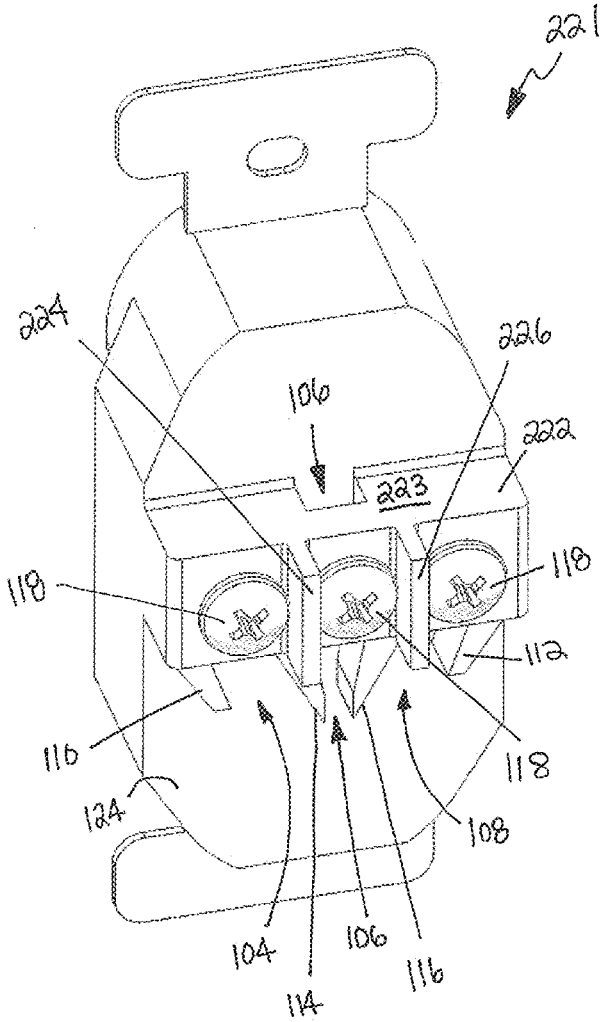
FIG. 30 a downward looking rear perspective view thereof.

Also, although not shown expressly in FIG. 29, 31 or 32, note that the height of the bridge 222 in relation to the back surface 124 of the electrical device housing is preferably large enough to permit at least two component wires to be secured therein—one each from one of two wire bundles. In this manner, the electrical circuit may be continued, divided, etc. as those skilled in the art will appreciate. The configuration of the inventive components with regard to the embodiment shown in FIGS. 24-32 allows, for example, for easier and faster wiring procedures in comparison with prior art devices, centralizing the electrical connections while providing safety and security thereto.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain some of the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A device for separating a wire bundle having a plurality of wires for securement in conductive communication with an electrical device comprising:

a surface having at least three threaded apertures;

a pair of side walls affixed to the surface;

a pair of separating fins each having an edge, affixed to the surface and disposed between the pair of side walls wherein the edges are arranged perpendicularly to the surface, and wherein the pair of side walls and pair of separating fins together define three channels;

a set screw engaging each threaded aperture of the at least three threaded apertures; and a contact area seated within each of the three channels and each conductively coupled to the electrical device, wherein one of the at least three threaded apertures and the set screw engaged thereto is located in each of the three channels in conductive communication with the contact area seated therein.

2. The device of claim 1 wherein the surface is the back surface of an electrical outlet housing.

3. The device of claim 1 further comprising a bridge extending over the channels and across the pair of side walls and the pair of separating fins having a series of apertures therethrough, wherein the set screws additionally pass through the series of apertures.

4. The device of claim 3 further comprising a pair of insulating fins affixed to the bridge and extending outwardly therefrom between each of the set screws.

5. The device of claim 3 wherein the bridge further comprises a rear surface whereby the at least three channels are closed thereby.

6. The device of claim 5 wherein the rear surface of the bridge further comprises an aperture such that a middle channel of the at least three channels is not closed by the rear surface.

7. The device of claim 2 further comprising a strain relief component secured to the surface and forming an arch sized to permit the wire bundle to pass therethrough and restrain the wire bundle from movement away from the surface.

8. The device of claim 7 wherein the strain relief component further comprises a pair of tabs on each end that mate with a pair of corresponding slots located in the side wall of the outlet.

9. The device of claim 1 wherein the separating fins are angled outward from a centerline of the surface.

10. The device of claim 1 wherein the surface is an inside surface of an electrical junction housing.

11. The device of claim 10 wherein the channels each have two ends, each located proximate to one of two bundled wire inlets.

12. The device of claim 11 wherein at least two threaded apertures and the set screw engaged thereto are located in each of the three channels in conductive communication with the contact area seated therein.

13. The device of claim 3 further comprising an electrical receptacle sized and configured to receive the device.

14. The device of claim 13 wherein the surface is sized to be received into the interior of the electrical receptacle.

15. The device of claim 14 further comprising a bundled wire inlet located at a first end of the surface sized to permit the plurality of wires to pass therethrough.

16. A method of separating a wire bundle having a plurality of wires and securing the plurality of wires in conductive communication with an electrical device comprising the steps of:

1. inserting an end of the wire bundle having the plurality of wires into a bundled wire component separator, the bundled wire component separator comprising a surface having at least three threaded apertures thereon, a pair of separating fins affixed thereto, a pair of side walls affixed thereto, wherein at least one side wall is located on either side of said separating fins, and at least three set screws that engage the at least three threaded apertures, wherein said side walls and said separating fins define three channels, said channels sized and spaced apart to separate the plurality of wires of the bundled wire from one another when said wires are forced against said separating fins, and wherein one of the at least three threaded apertures and one of the at least three set screws is located in each of the at least three channels, the plurality of wires of the bundled wire assembly separated into each channel by the separating fins and advanced until each end is located below the head of the set screw in each channel;
2. repeating step 1 as necessary for each bundled wire having a plurality of wires to be secured in the device; and
3. tightening the set screws to secure the plurality of wires between the head of the set screw and the surface where the contact area is located thereby placing each of the plurality of wires in conductive communication with the electrical device.

17. The method of claim 16 further comprising, between step 1 and step 2, the step of:

1A. further inserting the bundled wire having the plurality of wires until the distal end of the plurality of wires contacts a bridge having a surface which extends over the top surfaces of the separating fins and the side walls and over the rear surfaces of the separating fins and the side walls such that all but the middle channel of the at least three channels are capped by the bridge.

18. The method of claim 17 further comprising, between step 1A and step 2, the step of:

1B. inserting a ground wire into the top of the middle channel of the at least three channels.

19. The method of claim 18 further comprising, after step 2, the step of:

4. securing the bundled wire component separator in a corresponding receptacle that surrounds and secures the bundled wire component separator.

20. A device for separating a wire bundle having a plurality of wires and connecting the plurality of wires to a contact area in conductive communication with an electrical device comprising:

a surface located on the back of an electrical outlet;

a pair of separating fins affixed to the surface;

a pair of side walls affixed to said surface, wherein at least one side wall is located on either side of said separating fins;

at least three set screws;

a bridge extending over the top surfaces of the separating fins and the side walls having a series of apertures, wherein the set screws pass through the apertures in the bridge; and a pair of insulating fins affixed to the bridge and extending between each of the set screws;

wherein said side walls and said separating fins define three channels, said channels sized and spaced apart to separate the plurality of wires of the wire bundle from one another when said plurality of wires are forced against said separating fins;

wherein one of the at least three apertures and one of the at least three set screws is located in each of the at least three channels and secure each of the plurality of wires to the contact area for conductive communication with the electrical device; and wherein the bridge additionally extends over the rear surfaces of the separating fins and the side walls such that all but the middle channel of the at least three channels are capped by the bridge.

* * * * *